US006464387B1

(12) United States Patent
Stogsdill

(10) Patent No.: US 6,464,387 B1
(45) Date of Patent: Oct. 15, 2002

(54) MAGNETIC STIRRER HAVING A CHANNEL FOR FLUID

(76) Inventor: Fred Stogsdill, 6004 Frontier La., Plano, TX (US) 75023-4718

( * ) Notice: Subject to any disclaimer, the term of this patent is extended or adjusted under 35 U.S.C. 154(b) by 0 days.

(21) Appl. No.: 09/731,300

(22) Filed: Dec. 5, 2000

(51) Int. Cl.[7] ..... B01F 13/08
(52) U.S. Cl. ..... 366/273
(58) Field of Search ..... 366/273, 274; 416/3

(56) References Cited

U.S. PATENT DOCUMENTS

| | | | | |
|---|---|---|---|---|
| 2,562,714 A | | 7/1951 | Hawtof | |
| 2,844,363 A | * | 7/1958 | Clark | |
| 2,951,689 A | | 9/1960 | Asp et al. | |
| 3,088,716 A | * | 5/1963 | Stott | |
| 3,245,665 A | | 4/1966 | Steel | |
| 3,356,346 A | | 12/1967 | Landsberger | |
| 3,514,214 A | | 5/1970 | Vogtle et al. | 416/3 |
| 3,591,309 A | * | 7/1971 | Ray | |
| D226,346 S | * | 2/1973 | Newman | |
| 3,749,369 A | * | 7/1973 | Landsberger | |
| 3,997,272 A | | 12/1976 | George | |
| 4,162,855 A | * | 7/1979 | Bender | |
| 4,199,265 A | | 4/1980 | Sanderson et al. | 366/274 |
| 4,534,656 A | | 8/1985 | de Bruyne | 366/247 |
| 4,653,519 A | * | 3/1987 | Kanner | |
| 4,759,635 A | | 7/1988 | MacMichael et al. | 366/274 |
| 4,797,005 A | * | 1/1989 | Landsberger | |
| 5,240,322 A | | 8/1993 | Haber et al. | 366/130 |
| 5,533,800 A | | 7/1996 | Stiegelmann et al. | 366/142 |
| 5,586,823 A | | 12/1996 | Carr | 366/274 |
| 5,911,503 A | * | 6/1999 | Braden et al. | |

FOREIGN PATENT DOCUMENTS

| | | |
|---|---|---|
| DE | 2515634 | * 10/1976 |
| FR | 2430790 | * 3/1980 |
| GB | 2082930 | * 3/1982 |
| JP | 1-310514 | * 12/1989 |
| WO | 90/11126 | * 10/1990 |

* cited by examiner

*Primary Examiner*—Charles E. Cooley
(74) *Attorney, Agent, or Firm*—John A. Thomas

(57) ABSTRACT

A magnetic stirrer comprises a shell, which defines a cavity. The shell has at least one hole in its uppermost surface, the surface closest to the surface of the liquid to be mixed. The stirrer also has a plug disposed inside the cavity defined by the shell. The plug further comprises a channel running along its uppermost surface and its sides, so that the channel is in fluid communication with both the hole and the cavity. Embedded in the plug is a magnetic element, such as a permanent bar magnet. When an external magnetic field is rotated beneath a container containing the stirrer, the stirrer also rotates. As the stirrer rotates, liquid is impelled through the channel and downward through the cavity, creating a vortex above the stirrer and causing the stirrer to float off the bottom of the container and hover as it rotates.

13 Claims, 2 Drawing Sheets

( VIEW 2-2 )

( VIEW 2-2 )

MAGNETIC STIRRER HAVING A CHANNEL FOR FLUID

BACKGROUND

This invention relates generally to a magnetic stirring device, and in particular, to a stirrer suited to stirring liquids in bottles or containers having uneven bottoms.

Magnetic stirring of liquids within a closed bottle is a well-known technique. A stirrer bar in the liquid to be stirred is moved with stirring action by a magnetic field generated outside the bottle. The magnetic field may be produced by motor-driven magnets or switched coils. The stirrers normally used in such systems are permanent magnets encased in some chemically-inert material, such as glass or plastic. Such stirrers generally are denser than the medium to be stirred and thus sink to the bottom of the container. This is undesirable in the case of bottles or containers having uneven bottoms, such as bottles with extrusions or ribs on the bottom for strength.

Floating magnetic stirrers have been described in the prior art. However, these devices all use hollow floats which float on the top of the liquid surface. If the top of the liquid is far from the bottom of the container, the means of generating the magnetic field for rotation must be located along the sides of the container, adding to complexity and cost. What is needed is a stirrer which will float just above the bottom of the container as it rotates.

SUMMARY

In the preferred embodiment, the magnetic stirrer comprises a shell, which defines a cavity. The shell has at least one hole in its uppermost surface, the surface closest to the surface of the liquid to be mixed. The stirrer also has a plug. The plug is disposed inside the cavity defined by the shell and further comprises a channel running along its uppermost surface and its sides, so that the channel is in fluid communication with both the hole and the cavity.

Embedded in the plug is a magnetic element, such as a permanent bar magnet. When an external magnetic field is rotated beneath a container containing the stirrer, the stirrer also rotates. As the stirrer rotates, liquid is impelled through the channel and downward through the cavity, creating a vortex above the stirrer and causing the stirrer to float off the bottom of the container and hover as it rotates.

DRAWINGS

DESCRIPTION

Figure 1:
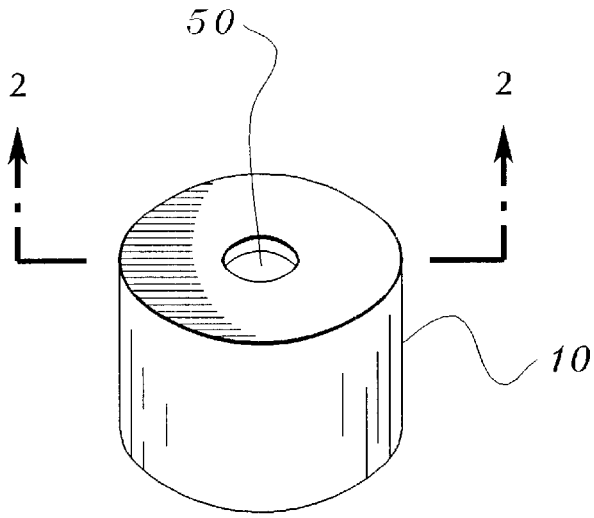
FIG. 1 is a perspective view of the preferred embodiment, showing the shell and a hole in the top of the shell.
Figure 2:
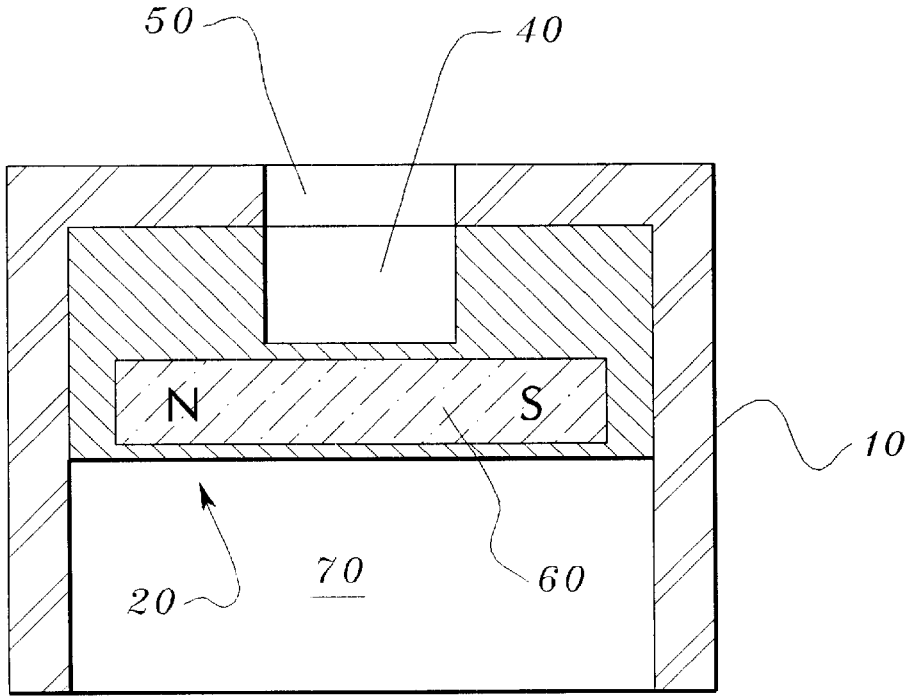
FIG. 2 is a vertical cross-sectional view of the preferred embodiment, showing the plug disposed in the shell, and the magnetic element within the plug.

As shown in FIGS. 1 and 2, the preferred embodiment of the stirrer comprises a shell (10) and a plug (20) which fits within the shell (10). The shell (10) has a hole (50) for circulation of liquid. In operation, the shell (10) is oriented so that the hole (50) is uppermost and closest to the surface of the liquid to be stirred.

Figure 3:
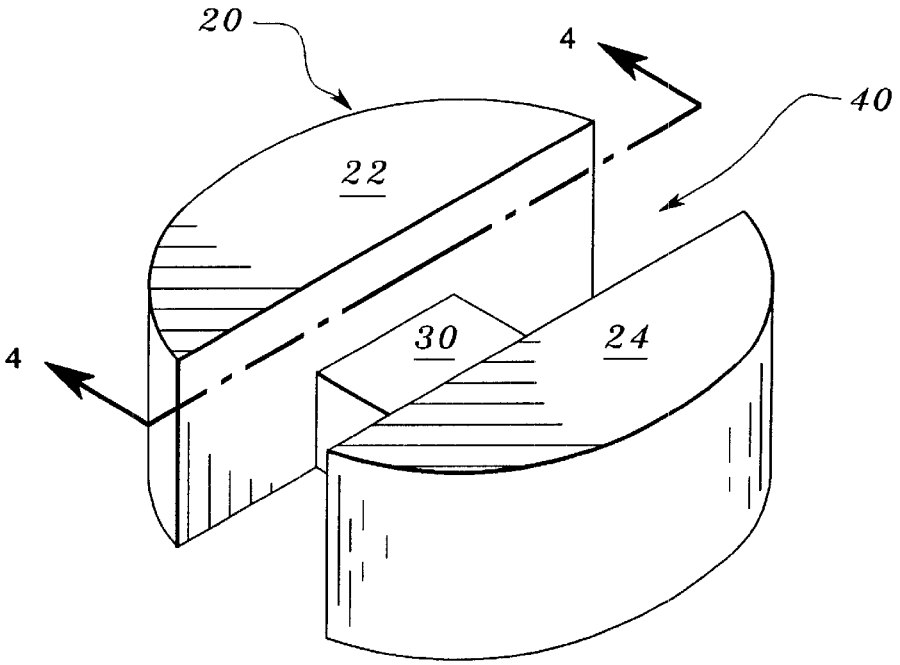
FIG. 3 is a perspective view of the plug of the preferred embodiment.
Figure 4:
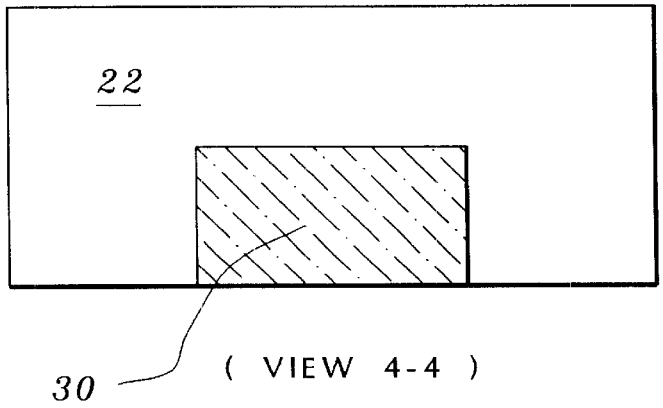
FIG. 4 is a horizontal cross-sectional view of the plug and the channels formed within it.

FIG. 2 shows the channel (40) along the uppermost part of the plug (20). As shown in FIGS. 3 and 4, the plug (20) may be divided into three parts for ease of manufacture, but the finished stirrer may be considered one integral article of manufacture. The plug (20) may be considered as having a first part (22) and a second part (24), and a cross member (30). The sections (22), (24) and the cross member (30) thus define a channel (40) along the uppermost surface and sides of the plug (20).

The plug (20) is sized to be congruent to the cavity (70) of the shell (10) and to fit snugly within it. The stirrer may be manufactured by molding or machining as an integral unit, or the stirrer may be assembled by inserting the plug (20) into the cavity (70) of the shell (10) as shown and holding it in place, such as by gluing or welding.

As will be seen by the drawings, the channel (40) now allows fluid communication between the hole (50) in the shell (10) and the cavity (70) of the shell (10).

A magnetic element (60), which may be a conventional bar magnet, or other magnetically susceptible material, is disposed within the plug (20) substantially perpendicular to the vertical axis of the shell (10). Thus the entire stirrer is rotated when the magnetic element (60) is immersed in the rotating magnetic field provided by an external magnetic stirrer.

The shell (10) and the plug (20) are made of a non-magnetic material impervious in extended immersion in typical chemical and biological liquids. Suitable materials include the silicone rubbers, or polytetrafluoroethylene resins (for example, TEFLON, from E. I. Du Pont De Nemours and Company). In general, the material should also be resistant to autoclaving. It is important to note that the shell (10) and plug (20) parts of the preferred embodiment may be made of different substances.

If the plug (20) and the shell (10) are constructed separately, they may be combined into the preferred embodiment shown by inserting the plug (20) into the cavity (70) defined by the shell (10) and securing it there by gluing, bonding, or welding. In other embodiments, the plug (20) and the shell (10) may be removably secured to each other, such as by a screw, or by threads, so they may be separated for more throrough cleaning, or to interchange shells (10) and plugs (20) having different densities.

In the preferred embodiment, the material or materials used for the shell (10) and plug (20) are also chosen so the the completed stirrer, including the magnetic element (60) has a density just slightly greater than that of the liquid to be stirred. This allows the stirrer to sink to the bottom of the container, but to be lifted off the bottom when rotated, as next described.

As the external magnetic field begins to rotate, the stirrer will also began to rotate. As it does, the liquid will be impelled through the channel (40) and downward into the cavity (70) of the shell (10). Liquid flow continues into the hole (50) on the upper surface of the shell (10) and into the channel (40). The downward flow lifts the stirrer off the bottom of the container and causes it to hover. The stirrer is thus freed of contact with the bottom of the container and is not affected by any extrusions or ribs on the bottom. The stirrer rises because of the increase of pressure between the cavity (70) and the liquid outside of the cavity (70). The stirrer floats above the bottom of the container in equilibrium when the volume of liquid entering the hole (50) in the shell (10) balances the liquid escaping from the cavity (70) of the shell (10).

I have observed the stirrer creates a vortex above it which insures through mixing of the liquid medium and also disturbs the liquid surface. This is desirable in many biological applications, because it causes mixing of gases in the atmosphere with the liquid.

The foregoing detailed description shows only certain particular embodiments of the present invention. However, those skilled in the art will recognized that many modifications and variations may be made without departing substantially from the spirit and scope of the present invention. Accordingly, it should be clearly understood that the form of the invention described is exemplary only and is not intended as a limitation on the scope of the invention as defined in the following claims.

I claim:

1. A stirrer, the stirrer comprising:

a. a shell defining a cavity; the shell having at least one hole;

b. a plug disposed inside the cavity, the plug comprising:

(i) at least one channel in fluid communication with the hole and the cavity; and, (ii) a magnetic element disposed inside the plug.

2. The stirrer of claim 1, where the stirrer has a density slightly greater than the liquid in which it is immersed.

3. The stirrer of claim 1, where the shell and plug are constructed of silicone rubber.

4. The stirrer of claim 1 where the shell and plug are constructed of a polytetrafluoroethylene resin.

5. The stirrer of claim 1 where the shell and plug are constructed of different materials.

6. The stirrer of claim 1 where the plug comprises a plurality of channels.

7. The stirrer of claim 1 where the magnetic element is a permanent bar magnet.

8. A stirrer, the stirrer having:

a. a shell defining a cavity; the cavity opening downward;

b. the shell further defining at least one hole; the hole opening upward;

c. a plug disposed inside the cavity, the plug comprising:

(i) at least one channel in fluid communication with the hole and the cavity; and, (ii) a magnetic element disposed inside the plug.

9. The stirrer of claim 8, where the stirrer has a density slightly greater than the liquid in which it is immersed.

10. The stirrer of claim 8, where the stirrer is constructed of silicone rubber.

11. The stirrer of claim 8, where the stirrer is constructed of polytetrafluoroethylene resin.

12. The stirrer of claim 8, comprising a plurality of channels.

13. The stirrer of claim 8, where the magnetic element is a permanent bar magnet.

* * * * *